US009354531B2

(12) United States Patent
Li et al.

(10) Patent No.: US 9,354,531 B2
(45) Date of Patent: May 31, 2016

(54) MAGENTA TONER

(71) Applicant: Xerox Corporation, Norwalk, CT (US)

(72) Inventors: Shigeng Li, Webster, NY (US); Christopher M Wolfe, Rochester, NY (US); Randy P Tin, Rochester, NY (US); Eric Godshall, Macedon, NY (US); Shigang Qiu, Toronto (CA); Peter V Nguyen, Webster, NY (US); Jay L Schneider, Canandaigua, NY (US); Linda S Schriever, Penfield, NY (US); Steven M Malachowski, East Rochester, NY (US); Amy A Grillo, Rochester, NY (US); Chieh-Min Cheng, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 30 days.

(21) Appl. No.: 14/321,785

(22) Filed: Jul. 1, 2014

(65) Prior Publication Data

US 2016/0004175 A1 Jan. 7, 2016

(51) Int. Cl.
*G03G 9/08* (2006.01)
*G03G 9/09* (2006.01)

(52) U.S. Cl.
CPC ..... *G03G 9/0808* (2013.01); *G03G 9/0804* (2013.01); *G03G 9/0821* (2013.01); *G03G 9/092* (2013.01)

(58) Field of Classification Search
CPC .... G03G 9/0804; G03G 9/0821; G03G 9/092
USPC ..... 430/107.1
See application file for complete search history.

(56) References Cited

U.S. PATENT DOCUMENTS 8,092,963 B2 * 1/2012 Vanbesien et al. ..... 430/108.1

* cited by examiner

*Primary Examiner* — Mark A Chapman
(74) *Attorney, Agent, or Firm* — Marylou J. Lavoie, Esq. LLC

(57) ABSTRACT

A process for making a latex emulsion where distillation occurs at an elevated temperature is used to make resin particles with a conditioned surface which can be used to make magenta toner with increased efficiency.

20 Claims, No Drawings

MAGENTA TONER

FIELD OF THE INVENTION

The present disclosure relates to an improved method for producing commercial amounts of toner that begins with an improved phase inversion emulsification (PIE) process for producing resin emulsions useful in making magenta toners, more specifically, an improved solvent, stripping process resulting in more rapid and efficient solvent removal in the latex distillation phase of PIE. Use of the accelerated processes disclosed herein increases latex production efficiency, reduces the cost of latex manufacture and results in more efficient production of toner.

BACKGROUND

Latex emulsions of resins may be produced using solvent-reuse PIE processes in which resins are dissolved in a mixture of water and organic solvent(s) (e.g., methyl ethyl ketone (MEK), isopropyl alcohol (IPA) or both) to form as homogenous water-in-oil (W/O) dispersion (i.e., water droplets dispersed in a continuous oil matrix). Subsequently, water is added to convert the dispersion into stable oil-in-water (O/W) latex (water as the continuous phase).

Organic solvent(s) is(are) removed (generally by vacuum distillation) and surfactant and/or other reagents, such as, preservatives, may be added to provide a stable latex with relatively high solid content of the resin. Such latex may be used for many purposes including in Emulsion Aggregation (EA) methods for the production of toner particles (see, e.g., U.S. Pat. Nos. 5,853,943, 5,902,710; 5,910,387; 5,916,725; 5,919,595; 5,925,488, 5,977,210 and 5,994,020, and U.S. Pub. No. 2008/0107989, the disclosure of each of which hereby is incorporated by reference in entirety.)

Production efficiency of magenta toner can be low, with, for example, low yield, low throughput, high GSD values (resulting from, for example, larger amounts of fine particles and/or coarse particles) and so on. The variability may arise from the red colorants and interaction thereof with other toner components.

It would be advantageous to develop processes that enhance latex production and magenta toner production.

SUMMARY

The instant disclosure describes an improved process fur making commercial amounts of a magenta toner using an improved process for making latex emulsions. The product latex particle is produced more rapidly and is more suitable for use in a toner composition, especially a magenta toner, than is a latex particle made by conventional methods. The distillation phase of the PIE of interest occurs at a higher temperature, such as, above the Tg of the resin(s) or above the boiling point of the solvent(s), to expedite solvent removal and to alter the surface of the latex particles.

In embodiments, a method of making a magenta toner in commercial amounts is disclosed comprising:

(a) making a latex by phase inversion emulsification (PIE) of a first emulsion comprising a first resin and a solvent, wherein solvent is distilled with said first emulsion exposed to a temperature above the Tg of an amorphous resin, the melting point of a crystalline resin or both when contained in said first emulsion;

(b) combining the latex with a wax and a magenta colorant to form a second emulsion;

(c) adding an aggregating agent to said second emulsion to form aggregated particles; and (d) coalescing said aggregated particles to form said magenta toner, wherein said magenta toner is produced in a higher yield, at a higher throughput, in less time, or a combination thereof, as compared to a similarly made control magenta toner comprising a control resin made with a solvent distillation temperature below the Tg of an amorphous resin, the melting point of a crystalline resin or both when contained in said control resin.

DETAILED DESCRIPTION

In the process of interest, a polyester resin is dissolved in a solvent, which can be a mixture of solvents, for example, methyl ethyl ketone (MEK) and isopropanol (IPA), distilled water (DIW) and optionally a base, such as, ammonia. A small quantity of base may be used to neutralize partially the polyester to promote resin dispersion within the solvent(s) and DIW. A second quantity of base (e.g., ammonia) may be added to the resin dissolution to neutralize further acid end groups on the polyester chains, followed by the addition of a second quantity of DIW to generate a uniform suspension of polyester particles in a water continuous phase via phase inversion. The emulsion then is exposed to a higher temperature to enhance solvent removal and to sculpt the particle surface to a state that is more conducive to aggregation.

In the EA process, the particle aggregation rate impacts the entire EA cycle time, which determines productivity of EA toner. Since latexes compose the largest amount of raw material in the batch, the aggregation process is influenced by the aggregation rate of latex particles. Hence, EA toner productivity can be improved by increasing the aggregation rate of latex particles, for example, by modifying the latex particles, such as, the morphology and other properties thereof, such as, the surface architecture of the particles.

The rate of aggregation depends, in part, on the probability of collision between particles, the probability of attachment during collisions and the subsequent detachment of a particle from an aggregate. The probability of collision can depend on:

i) Brownian motion, which is determined by the temperature of the system; and ii) fluid flow motion determined by the viscosity of the fluid medium and external stirring. The probabilities of adhesion and detachment can depend on the type of physicochemical interactions between the particles and, to some extent, on the velocity gradients in the medium. Therefore, to accelerate particle aggregation, the probability of collision and attachment of particles should be increased and the probability of particle detachment should be decreased.

According to the Derjaguin-Landau-Verwey-Overbeek (DLVO) theory, the total interaction between particles which impacts aggregation rate is superposition of van der Waals and electrostatic double layer interactions. Hence, a way to improve aggregation rate is to reduce or even remove van der Waals and electrostatic double layer interactions among latex particles.

The literature reports presence of a, "hairy," layer around a latex particle which would form a steric barrier to aggregation (Verdegan & Anderson, J Colloid Interf Sci, 158, 372-381, 1993; Chow & Takamura, J Colloid Interf Sci, 125, 226-236, 1988; and Midmore & Hunter, J Colloid Interf Sci, 122, 521-529, 1988).

The hairy layer can be reduced or even removed with heat treatment (Seebergh & Berg, Colloids Surf A, 100, 139, 1995; Rosen & Saville, J Colloid Interf Sci, 140, 82, 1990; and Rosen & Saville, J Colloid Interf Sci, 149, 542, 1992), which establishes a better agreement between the theoretical DLVO model and experimental results.

Chains of resin polymers can extend from the surface of the particle forming the, "hairs," on the surface of the particle. The hairs on the latex particle extend into the bulk solution due to the electrostatic, repulsion between the ionic groups neutralized by ammonia during the latex conversion process. As the temperature increases above the Tg, some of the hairy layer will collapse back and onto the particle surface. That leads to reduction of electrostatic repulsion. That also could remove partially the steric barrier and provide a more exposed particle surface for enhanced aggregation between particles resulting in toner productivity improvement.

Unless otherwise indicated, all numbers expressing quantities and conditions, and so forth used in the specification and claims are to be understood as being modified in all instances by the term, "about." "About," is meant to indicate a variation of no more than 10% from the stated value. Also used herein is the term, "equivalent," "similar," "essentially," "substantially," "approximating," and, "matching," or grammatic variations thereof, have generally acceptable definitions or at the least, are understood to have the same meaning as, "about."

As used herein, "commercial," relates to a scale of toner production greater than a bench scale and greater than a pilot scale. In terms of dry toner, a commercial scale of dry toner is produced in an amount of more than about 100 kg, more than about 200 kg, more than about 300 kg, more than about 400 kg, more than about 500 kg, more than about 600 kg, more than about 700 kg, more than about 800 kg, more than about 900 kg, more than about 1000 kg, more than about 1250 kg, more than about 1500 kg, more than about 1750 kg, more than about 2000 kg, more than about 2250 kg, more than about 2500 kg, more than about 2750 kg, more than about 3000 kg, more than about 3250 kg, more than about 3500 kg or more in a run. In the context of a batch reaction, a commercial production occurs in a reactor of at least about 1000 gal, at least about 1250 gal, at least about 1500 gal, at least about 1750 gal, at least about 2000 gal, at least about 2250 gal, at least about 2500 gal, at least about 2750 gal, at least about 3000 gal or more in size and amount.

Resins

Any resin may be utilized in forming a latex emulsion of the present disclosure. The resins may be an amorphous resin, a crystalline resin, and/or a combination thereof. The resin may be a polyester resin, including the resins described, for example, in U.S. Pat. Nos. 6,593,049 and 6,756,176, the disclosure of each of which hereby is incorporated by reference in entirety. Suitable resins also may include a mixture of an amorphous polyester resin and a crystalline polyester resin as described in U.S. Pat. No. 6,830,860, the disclosure of which hereby is incorporated by reference in entirety. Suitable resins may include a mixture of high molecular and low molecular weight amorphous polyester resins.

The resin may be a polyester resin formed by reacting a dial with a diacid in the presence of an optional catalyst.

The diol may be, for example, selected in an amount of from about 40 to about 60 mole percent, from about 42 to about 55 mole percent, from about 45 to about 53 mole percent, and optionally, a second diol can be selected in an amount of from about 0 to about 10 mole percent, from about 1 to about 4 mole percent of the resin. The diacid may be selected in an amount of, for example, from about 40 to about 60 mole percent, from about 42 to about 52 mole percent, from about 45 to about 50 mole percent, and optionally, a second diacid may be selected in an amount of from about 0 to about 10 mole percent of the resin.

Polycondensation catalysts may be utilized in forming either the crystalline or amorphous polyesters and include tetraalkyl titanates, dialkyltin oxides, such as, dibutyltin oxide, tetraalkyltins, such as, dibutyltin dilaurate, and dialkyltin oxide hydroxides, such as, butyltin oxide hydroxide, aluminum alkoxides alkyl zinc, dialkyl zinc, zinc oxide, stannous oxide or combinations thereof. Such catalysts may be utilized in amounts of, for example, from about 0.01 mole percent to about 5 mole percent based on the starting diacid or diester used to generate the polyester resin.

Examples of crystalline resins include polyesters, polyamides, poltimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(nonylene-decanoate), poly(octylene-adipate). Examples of polyamides include poly(ethylene-adipamide), polypropylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide) and poly(butylene-succinimide).

The crystalline resin may be present, for example, in an amount of from about 1 to about 20 percent by weight of the toner components, from about 2 to about 15 percent by weight of the toner components. The crystalline resin may possess various melting points of, for example, from about 30° C. to about 120° C., from about 50° C. to about 90° C. The crystalline resin may have a number average molecular weight (Mn), as measured by gel permeation chromatography (GPC) of, for example, from about 1,000 to about 50,000, from about 2.000 to about 25,000, and a weight average molecular weight (Mw) of, for example, from about 2,000 to about 100,000, from about 3,000 to about 80,000, as determined by GPC. The molecular weight distribution Mw/Mn) of the crystalline resin may be, for example, from about 2 to about 6, from about 3 to about 5.

An amorphous resin or combination of amorphous resins utilized in the latex may have a glass transition temperature (Tg) of from about 30° C. to about 80° C., from about 35° C. to about 70° C. In embodiments, the combined resins utilized in the latex may have a melt viscosity of from about 10 to about 1,000,000 Pa*S at about 130° C., from about 50 to about 100,000 Pa*S at about 130° C.

One, two or more resins may be used. Where two or more resins are used, the resins may be in any suitable ratio (e.g., weight ratio), such as, of from about 1% (first resin)/99% (second resin) to about 99% (first resin)/1% (second resin), in embodiments, from about 10% (first resin)/90% (second resin) to about 90% (first resin)/10% (second resin).

A suitable toner of the present disclosure may include two amorphous polyester resins and a crystalline polyester resin. The weight ratio of the three resins may be from about 30% first amorphous resin/65% second amorphous resin/5% crystalline resin, to about 60% first amorphous resin/20% second amorphous resin/20% crystalline resin.

A suitable toner of the present disclosure may include at least two amorphous polyester resins, a high molecular weight resin and a low molecular weight resin. As used herein, a high molecular weight (iMW) amorphous resin may have a weight average molecular weight (Mw) of from about 35,000 to about 150,000, from about 45,000 to about 140,000, and a low molecular weight (LMW) amorphous resin may have an Mw of from about 10,000 to about 30,000, from about 15,000 to about 25,000.

The weight ratio of the two resins may be from about 10% first amorphous resin/90% second amorphous resin, to about 90% first amorphous resin/10% second amorphous resin.

A resin may possess acid groups which, in embodiments, may be present at a terminus of a polymer. Acid groups include carboxylic acid groups and the like. The number of acid groups may be controlled by adjusting, the materials utilized to form the resin and reaction conditions.

A resin may have an acid number from about 2 mg to about 200 mg KOH/g of resin, from about 5 mg to about 50 mg, from about 10 mg to about 15 mg KOH/g of resin.

Other suitable resins that can be used to make toner comprise a styrene, an acrylate, such as, an alkyl acrylate, such as, methyl acrylate, ethyl acrylate, butyl acrylate, isobutyl acrylate, dodecyl acrylate, n-octyl acrylate, n-butylacrylate, 2-chloroethyl acrylate β-carboxy ethyl acrylate (β-CEA), phenyl acrylate, methacrylate, butadienes, isoprenes, acrylic acids, acrylonitriles, styrene acrylates, styrene butadienes, styrene methacrylates, and so on, such as, methyl α-chloroacrylate, methyl methacrylate, ethyl methacrylate, butyl methacrylate, butadiene, isoprene, methacrylonitrile, acrylonitrile, vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as vinyl methyl ketone, vinyl hexyl ketone, methyl isopropenyl ketone and the like; vinylidene halides, such as, vinylidene chloride, vinylidene chlorofluoride and the like; N-vinyl N-vinyl pyrrolidone, methacrylate, acrylic acid, methacrylic acid, acrylamide, methacrylamide, vinylpyridine, vinylpyrrolidone, vinyl-N-methylpyridinium chloride, vinyl naphthalene, p-chlorostyrene vinyl chloride, vinyl bromide, vinyl fluoride, ethylene, propylene, butylene, isobutylene and mixtures thereof. A mixture of monomers can be used to make a copolymer, such as, a block copolymer, an alternating copolymer, a graft copolymer and so on.

In embodiments, the shell latex, the core latex, or both, may be functionalized with a group that imparts hydrophobicity to the latex so sensitivity to relative humidity is improved. Suitable functional groups include, for example, alkaline earth resins or other metal resins including, but not limited to, calcium resinates, beryllium resinates, magnesium resinates, strontium resinates, barium resinates, radium resinates, zinc resinates, aluminum resinates, copper resinates, iron resinates, and combinations thereof in embodiments, the surface-functionalized latex may possess a calcium resinate as the functional group, see, U.S. Pat. No. 7,553,601, the content of which is incorporated herein by reference in entirety.

Solvent

Any suitable organic solvent may be used to dissolve the resin, for example, alcohols, esters, ethers, ketones, amines and combinations thereof, in an amount of, for example, from about 30% by weight to about 400% by weight of the resin, from about 40% by weight to about 250% by weight of the resin, from about 50% by weight to about 100% by weight of the resin.

Suitable organic solvents, sometimes referred, to as phase inversion agents, include, for example, methanol, ethanol, propanol. IPA, butanol, ethyl acetate, MEK and combinations thereof. In embodiments, the organic solvent may be immiscible in water and may have a boiling point of from about 30° C. to about 120° C., which can be selected to be lower to enhance removal following latex formation, such as lower than the Tg of the resin(s). In embodiments, when at least two solvents are used, the ratio of solvents can be from about 1:2 to about 1:15, from about 1:2.5 to about 1:12.5, from about 1:3 to about 1:10, although other ratios can be used as a design choice.

Neutralizing Agent

A resin optionally may be mixed with a weak base, buffer or a neutralizing agent. In embodiments, the neutralizing agent may be used to neutralize acid groups in the resins, so a neutralizing agent no matter the source or content herein also may be referred to as a, "basic neutralization agent." Any suitable basic neutralization reagent may be used in accordance with the present disclosure. Suitable agents may include inorganic basic agents and organic basic agents. Suitable basic agents may include ammonium hydroxide, potassium hydroxide, sodium hydroxide, sodium carbonate, sodium bicarbonate, lithium hydroxide, potassium carbonate, combinations thereof and the like. Suitable basic agents may also include monocyclic compounds and polycyclic compounds having at least one nitrogen atom, such as, for example, secondary amines, which include aziridines, azetidines, piperazines, piperidines, pyridines, bipyridines, terpycidines, dihydropyridines, morpholines, N-alkylmorpholines, 1,4-diazabicyclo[2.2.2]octanes, 1,8-diazabicycloundecanes, 1,8-diazabicycloundecenes, dimethylated pentylamines, trimethylated pentylamines, pyrimidines, pyrroles, pyrrolidines, pyrrolidinones, indoles, indolines, indanones, benzindazones, imidazoles, benzimidazoles, imidazolones, imidazolines, oxazoles, isoxazoles, oxazolines, oxadiazoles, thiadiazoles, carbazoles, quinolines, isoquinolines, naphthyridines, triazines, triazoles tetrazoles, pyrazoles, pyrazolines and combinations thereof. The monocyclic and polycyclic compounds may be unsubstituted or substituted at any carbon position on the ring.

The basic agent may be utilized in an amount of from about 0.001% by weight to 50% by weight of the resin, from about 0.01% by weight to about 25% by weight of the resin, from about 0.1% by weight to 5% by weight of the resin. The neutralizing agent may be added in the form of an aqueous solution. The neutralizing agent may be added in the form of a solid. Plural forms of base can be used in a process of interest. Hence, a process can comprise a first base, and at as different or successive step, as second base is used. The first and second bases can be the same or different.

Utilizing the above basic neutralization agent in combination with a resin possessing acid groups, a neutralization ratio of from about 25% to about 300% may be achieved, from about 50% to about 200%. In embodiments, the neutralization ratio may be calculated as the molar ratio of basic groups provided with the basic neutralizing agent to the acid groups present in the resin multiplied by 100%.

Addition of the basic neutralization agent may raise the pH of an emulsion including a resin possessing acid groups from about 5 to about 12, from about 6 to about 11. Neutralization of the acid groups may enhance formation of the emulsion.

An emulsion formed in accordance with the present disclosure includes a quantity of water, in embodiments, deionized water (DIW) in amounts and at temperatures that melt or soften the resin, of from about 25" C to about 120° C., from about 35" C to about 80° C.

Surfactants

Processes of the present disclosure may include adding a surfactant, for example, before or during combining reagents, to the resin at an elevated temperature, in an emulsion, in a dispersion and so on. The surfactant may be added prior to mixing the resin at an elevated temperature.

Where utilized, a resin emulsion or a dispersion may include one, two or more surfactants. The surfactants may be selected from ionic surfactants and nonionic surfactants. Anionic surfactants and cationic surfactants are encompassed by the term, "ionic surfactants." In embodiments, the surfactant may be added as a solid or as a solution with a concentration of from about 5% to about 100% (pure surfactant) by weight, from about 10% to about 95% by weight. In embodiments, the surfactant may be utilized, in an amount of from about 0.01% to about 20% by weight of the resin, from about 0.1% to about 16% by weight, from about 1% to about 14% by weight of the resin.

Latex Processing

The present process comprises forming a mixture by any known means, optionally, at an elevated temperature above room temperature (RT), containing at least one resin, at least one organic solvent, optionally a surfactant and optionally a neutralizing agent to form a latex emulsion. The resin(s) may be preblended prior to combining or mixing.

In embodiments, the elevated temperature for forming the mixture is near to or above the $T_g$ of the resin(s). In embodiments, the resin may be a mixture of low and high molecular weight amorphous resins.

Thus, a process of the present disclosure may include contacting at least one resin with an organic solvent to form a resin mixture, heating the resin mixture to an elevated temperature, stirring the mixture, optionally adding a neutralizing agent to neutralize the acid groups of the resin, adding water until phase inversion occurs to form a phase inversed latex emulsion, distilling the latex at an elevated temperature to remove solvent, and to produce a latex, such as, with a low polydispersity, a lower percentage of fines, a lower percentage of coarse particles, a sculpted particle surface and so on, in an shortened process.

In the phase inversion process, resin in may be dissolved in a low boiling point organic solvent, which solvent is miscible or partially miscible in water at a concentration of front about 1% by weight to about 75% by weight resin in solvent, from about 5% by weight to about 60% by weight resin in solvent. The resin mixture then is heated to a temperature of from about 25° C. to about 90° C., from about 30° C. to about 85° C. The heating need not be held at a constant temperature, but may be varied. For example, the heating may be increased slowly or incrementally until a desired temperature is achieved.

Water is added, for example, in two portions to form a uniform dispersion of resin particles in water through phase inversion.

The organic solvents remain in both the resin particles and water phase at that state. The organic solvent(s) then can be stripped through, for example, heating and vacuum distillation. The heating is at a temperature elevated over current procedures and is selected to be over the Tg of the resin(s) in the emulsion. The solvents can be selected to ensure ready removal at such a temperature, that is, solvents with boiling points below, at or near the Tg of the resin(s) can be selected for ready removal from the emulsion.

In embodiments, the resin to solvent ratio may be from about 8:1 to about 3:1. When two solvents are used, and an LMW resin is included, the ratio of the LMW resin to the first and to the second solvents can be, for example, about 10:6:1.5. When an HMW resin is included with two solvents, the ratio of the resin to the first and to the second solvents can be for example, about 10:8:2; although ratios different from those can be used.

The mixing temperature may be from about 35° C. to about 100° C. from about 40° C. to about 90° C. from about 50° C. to about 70° C.

Once the resin(s), optional neutralizing agent and optional surfactant are combined, the mixture then may be contacted with a first portion of a water, to form a W/O emulsion. Water may be added to form a latex with a solids content of from about 5% to about 60%, from about 10% to about 50%. While higher water temperatures may accelerate dissolution, latexes may be formed at temperatures as low as RT. In embodiments, water temperatures may be from about 40° C. to about 110° C. from about 50° C. to about 90° C.

The amount of water comprising the first portion of water is an amount suitable to form a W/O emulsion Phase inversion can occur at about a 1:1 w/w or v/v ratio of organic phase to aqueous phase. Hence, the first portion of water generally comprises less than about 50% of the total volume or weight of the final emulsion. The first portion of water can be less than about 95% of the volume or weight of the organic phase, less than about 90%, less than about 85% or less of the volume or weight of the organic phase. Lower amounts of water can be used in the first portion so long as a suitable W/O emulsion is formed.

Phase inversion occurs on adding an optional aqueous alkaline solution or basic agent, optional surfactant and a second portion of water to create a phase inversed emulsion including a dispersed phase including droplets possessing the molten ingredients of the resin composition and a continuous phase including the water.

Combining may be conducted, in embodiments, utilizing any means within the purview of those skilled in the art. For example, combining may be conducted in a glass kettle with an anchor blade impeller, an extruder, i.e., a twin screw extruder, a kneader, such as, Haake mixer, a batch reactor or any other device capable of intimately mixing viscous materials to create near or homogenous mixtures.

Stirring, although not necessary, may be utilized to enhance formation of the latex. Any suitable stirring device may be utilized. In embodiments, the stirring ma be at a speed of from about 10 revolutions per minute (rpm) to about 5,000 rpm, from about 20 rpm to about 2,000 rpm, from about 50 rpm to about 1,000 rpm. The stirring need not be at a constant speed and may be varied. For example, as the heating of the mixture becomes more uniform, the stirring rate may be increased. In embodiments, a homogenizer (that is, a high shear device), may be utilized to form the phase inversed emulsion. Where utilized, a homogenizer may operate at a rate of from about 3,000 rpm to about 10,000 rpm.

Although the point of phase inversion may vary depending on the components of the emulsion, the temperature of heating, the stirring speed, tract the like, phase inversion may occur when the optional basic neutralization agent, optional surfactant and water are added so that the resulting resin is present in an amount from about 5% by weight to about 70% by weight of the emulsion, from about 20% by weight to about 65% by weight, from about 30% by weight to about 60% by weight of the emulsion.

Following phase inversion, additional optional surfactant, water, and optional aqueous alkaline solution may be added to dilute the phase inversed emulsion.

Distillation with stirring of the emulsion is performed under elevated temperatures to hasten solvent removal and to sculpt the particle surface. The elevated temperature is above the Tg, or melting point of the resin(s) and about the boiling point of the solvent(s). Resin emulsion particles can have an average diameter of less than about 300 nm, less than about 250 nm, less than about 200 nm.

Heating may occur by application to the outer surface of the vessel carrying the emulsion. For example, using a jacket. The temperature of the jacket is the elevated temperature, that is, above the Tg of the resin(s). The heating device causes the walls of the vessel to adopt the elevated temperature, which then is passed to the emulsion contained in the vessel. Because the vessel contents are under agitation, generally, the fluid layer adjacent to the inner surface of the vessel adopts the elevated temperature of the heating means. The heat is passed to the central portion of the emulsion through mass action and any stirring, agitation, mixing and the like of the emulsion. Because the solvent near the periphery are the first to be heated to near, at or over the solvent(s) boiling point(s), those solvent molecules evaporate and that heat is carried in the vaporized solvent. The heat thus follows the vaporized solvent into the gaseous phase and reduces the temperature of the emulsion. The result is the overall hatch temperature of the emulsion can be about 20° C. lower than the applied elevated temperature. The temperature of the heating device can be adjusted to obtain a desired average overall emulsion temperature, at the levels described herein, depending on the resin(s) used, solvent(s) used and so on, as a design choice.

When sufficient solvent is removed, which is determined by known analytic techniques, such as, gas chromatography (GC), the distillation is discontinued resulting in a latex. The liquid can be: removed, the particles washed and so on, as known in the art. The resin particles are produced more rapidly, are suitable for use in toner and are of a quality that facilitates and enhances toner production, particularly at a commercial scale. The solvent stripping phase is shortened due to the applied elevated temperatures. The solvent stripping phase can be about 15% shorter, about 20% shorter, about 25% shorter, or more than the solvent stripping phase in a similar process but not employing an elevated temperature during the solvent removal step.

The desired properties of the resin emulsion (i.e., particle size and low residual solvent level) may be achieved by adjusting the solvent and neutralizer concentration and process parameters (e.g., reactor temperature, vacuum and process time).

Toner

Once the resin mixture has been contacted with water to form an emulsion and the solvent removed, from the mixture as described above, the resulting latex then may be utilized, to form a toner by any method within the purview of those skilled in the art. The latex emulsion may be contacted with a magenta colorant, optionally in a dispersion, a wax, optionally in a dispersion, and other additives to form a toner by a suitable process, in embodiments, an emulsion aggregation and coalescence process.

Colorants

One or more colorants may be added, and various known suitable colorants, such as dyes, pigments, mixtures of dyes, mixtures of pigments, mixtures of dyes and pigments, and the like, may be included in the magenta toner. In embodiments, the colorant, when present, may be included in the toner in an amount of, for example, from about 3 to about 15% by weight of the toner, from about 4 to about 12% by weight of the toner, from about 5 to about 10% by weight of the toner, although the amount of colorant can be outside of those ranges.

Any one or more colorants can be used to make the magenta toner, such as, pigment red (PR) 122. PR185, PR192, PR202, PR206, PR235, PR269 or combination thereof, such as, a 1:1 weight ratio of PR122 and PR269.

Colorants other than a red colorant can be included in a toner of interest, as a design choice, to obtain a hue and/or a shade of interest.

Wax

Optionally, a wax may also be combined with the resin and an optional colorant in forming toner particles. The wax may be provided in a wax dispersion, which may include a single type of wax or a mixture of two or more different waxes.

When included, the wax may be present in an amount of, for example, from about 1% by weight to about 25% by weight of the toner particles, from about 5% by weight to about 20% by weight of the toner particles, although the amount of wax can be outside of those ranges.

When a wax dispersion is used, the wax dispersion may include any of the various waxes conventionally used in emulsion aggregation toner compositions. Waxes that may be selected include waxes having, for example, an average molecular weight of from about 500 to about 20,000, from about 1,000 to about 10,000.

Waxes that may be used include, for example, polyolefins, such as, polyethylene including linear polyethylene waxes and branched polyethylene waxes, polypropylene including linear polypropylene waxes and branched polypropylene waxes, polyethylene/amide, polyethylenetetralluoroethylene, polyethylenetetrafluoroethylene/amide, naturally occurring waxes such as those obtained from plant sources or animal sources, and polybutene waxes. Mixtures and combinations of the foregoing waxes may also be used, in embodiments. In embodiments, the waxes may be crystalline or non-crystalline.

In embodiments, the wax may be incorporated into the toner in the form of one or more aqueous emulsions or dispersions of solid wax in water, e.g., where the solid wax particle size may be in the range of from about 100 to about 500 nm.

Toner Preparation

Toner compositions are prepared by EA processes, such as, a process that includes aggregating a mixture of a colorant, an optional wax and any other desired or required additives, and emulsions including the thermally-treated resins described herein, optionally in surfactants as described herein, and then coalescing the aggregated particles. A mixture may be prepared by adding a colorant, and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. The pH of the mixture may be adjusted to from about 2 to about 5. Additionally, in embodiments, the mixture may be homogenized. If the mixture is homogenized, that may be by mixing e.g., at about 600 to about 6,000 rpm. Homogenization may be accomplished by any suitable means, including, to example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, an inorganic cationic aggregating agent, such as, polyaluminum halides, such as, polyaluminum chloride (PAC), or the corresponding bromide, fluoride or iodide, polyaluminum silicates, such as, polyaluminum sulfosilicate (PASS), and water soluble metal salts, including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate and combinations thereof. In embodiments, the aggregating agent may be added to the mixture at a temperature that is below the Tg of the resin.

The aggregating agent may be added to the mixture utilized to form a toner in an amount of, for example, from about 0.1% to about 10% by weight, from about 0.2% to about 8% by weight, from about 0.3% to about 5% by weight, of the resin in the mixture.

The particles may be permitted to aggregate until a predetermined desired particle size is obtained. Particle size can be monitored during the growth process, for example with a COULTER COUNTER, for average particle size. The aggregation may proceed by maintaining the elevated temperature, or slowly raising the temperature to, for example, from about 40° C. to about 100° C., and holding the mixture at that temperature for a time of from about 0.5 hours to about 6 hours, from about 1 hour to about 5 hours, while maintaining stirring, to provide the aggregated particles. Once the desired size is reached, an optional shell resin can be added.

Shell

In embodiments, after aggregation, but prior to coalescence, a resin coating may be applied to the aggregated particles to form a shell thereover. In embodiments, the core may thus include one or more of an amorphous resin and/or a crystalline resin, as described herein. Any resin described above, including a thermally-treated resin, may be utilized in the shell.

Multiple resins may be utilized in any suitable amounts. Accordingly, a first resin may be present in an amount of from about 20% by weight to about 100 from about 30% by weight to about 90 by weight of the total shell resin. A second resin may be present in the shell resin in an amount of from about 0% by weight to about from about 10% by weight to about 70% by weight of the shell resin.

The shell resin may be applied to the aggregated particles by any method within the purview of those skilled in the art. In embodiments, the resins utilized to form the shell may be in an emulsion, including any surfactant described above.

The formation of the shell over the aggregated particles may occur while heating to a temperature of from about 30° C. to about 40° C., from about 35° C. to about 70° C. Formation of the shell may take place for a period of time of from about 5 min to about 10 hr, from about 1.0 minutes to about 5 hours.

The shell may be present in an amount of from about 10 by weight to about 40% by weight of the latex particles, from about 20 by weight to about 35% by weight of the latex particles.

Once the desired final size of the toner particles is achieved, the pH of the mixture may be adjusted with a base or a buffer to a value of from about 3 to about 10, from about 5 to about 9. The adjustment of the pH may be utilized to freeze, that is, to stop, toner particle growth. The base utilized to stop toner growth may include any suitable base such as, for example, alkali metal hydroxides, such as, for example, sodium hydroxide, potassium hydroxide, ammonium hydroxide, combinations thereof and the like. In embodiments, a chelator, such as, ethylene diamine tetraaceticacid (EDTA), may be added to help adjust the pH to the desired values.

Coalescence

Following aggregation to the desired particle size and application of any optional shell, the particles may then be coalesced to the desired final shape, the coalescence being achieved by, for example, heating the mixture to a temperature of from about 45° C. to about 100° C., from about 55° C. to about 99° C., which is at or above the Tg of the resin(s) utilized to form the toner particles. Coalescence may be accomplished over a period of from about 0.01 to about 9 hours, from about 0.1 to about 4 hours.

After aggregation and/or coalescence, the mixture may be cooled to RT, such as, from about 20° C. to about 25° C. The cooling may be rapid or slow, as desired. A suitable cooling method may include introducing cold water to i jacket around the reactor. After cooling, the toner particles may be optionally washed with water and then dried. Drying may be accomplished by any suitable method for drying, including, for example, freeze-drying.

Additives

In embodiments, the toner particles may contain other optional additives, as desired or required. For example, the toner may include positive or negative charge control agents, for example, in an amount of from about: 0.1 to about 10% by weight of the toner, from about 1 to about 3% by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in entirety; organic sulfate and sulfonate compositions, including those disclosed in U.S. Pat. No. 4,338,390, the disclosure of which is hereby incorporated by reference in entirety; cetyl pyridinium tetrafluoroborates; distearyl dimethyl ammonium methyl sulfate; aluminum salts, such as, BONTRON E84™ or E88™ (Orient Chemical Industries, Ltd.); combinations thereof and the like.

There can also be blended with the toner particles external additive particles after formation including flow aid additives, which additives may be present on the surface of the toner particles. Examples of the additives include metal oxides, such as, titanium oxide, silicon oxide, aluminum oxides, cerium oxides, tin oxide, mixtures thereof and the like; colloidal and amorphous silicas, such as, AEROSIL®, metal salts and metal salts of fatty acids inclusive of zinc stearate and calcium stearate, or long chain alcohols, such as, UNILIN 700, and mixtures thereof. Each of the external additives may be present in an amount of from about 0.1% by weight to about 5% by weight of the toner from about 0.25% by weight to about 3% by weight of the toner, although the amount of additives can be outside of those ranges.

Toners of the present disclosure may be utilized, as ultra low melt (ULM) toners comprising suitable resins of appropriate Tg, low melt wax and so on.

Dry toner particles, optionally having a shell, may, exclusive of external surface additives, have the characteristics: (1) volume average diameter (also referred to as "volume average particle diameter") of from e.g., about 3 to about 25 μm, from about 4 to about 15 μm, from about 5 to about 12 μm; (2) number average geometric size distribution (GSDn) and or volume average geometric size distribution (GSDv) of from e.g., about 1.05 to about 1.55, from about 1.1 to about 1.4; and (3) circularity of from about 0.93 to about 1 from about 0.95 to about 0.99 (as measured with, for example, as Sysmex FPIA 2100 analyzer).

The characteristics of toner particles may be determined by any suitable technique and apparatus, such as, a Beckman Coulter MULTISIZER 3. The range and distribution of particle sizes can be so obtained. The particle distribution provides percentages of fine particles and of coarse particles, relative to particles of the desired mean size. A measure of the content of coarse particles is the $VD_{84}$ metric where coarse particles are those larger than the $84^{th}$ percentile in size. Another metric for assessing the content of coarse particles is the ratio, $VD_{84}/VD_{50}$, where a value of 1.23 or less, 1.22 or less, 1.21 or less, or lower is indicative of lower or acceptable levels of coarse particles. A measure of the content of fine particles is the $ND_{16}$ metric where fine particles are those smaller than the $16^{th}$ percentile in size. Another metric for assessing the content of fine particles is the ratio, $ND_{50}/ND_{16}$, where a value of 1.30 or less, 1.29 or less, 1.28 or less, or lower is indicative of lower or acceptable levels of fine particles. The thermal process for making resin results in lower fines content, lower coarse content or both.

Toner production is enhanced using a thermally-treated latex of interest. For example, throughput, a measure of toner product per unit time, is increased when using a thermally-treated resin of interest. Generally, throughput of toner is about 600 kg/hr. A magenta toner of interest, containing thermally-treated resin, has a throughout of at least about 700 kg/hr at least about 750 kg/hr, at least about 800 kg/hr.

Yield can be a theoretic calculation based on the input amounts and assuming either 100% reaction efficiency or a known historic efficiency value to obtain an expected amount of product. The actual amount of product is compared to the expected amount. Alternatively, yield can reflect a historic, average of product produced. Yield of toner practicing the instant methods is enhanced when using a thermally-treated resin of interest. The yield generally is at least about 1.5% greater, at least about 1.75% greater, at least about 2% greater, at least about 2.25% greater, at least about 2.5% greater, or more than observed when resin used in the toner is not heat-treated, that is, the resin is produced by PIE but without the heat treatment solvent stripping step. At the level at which toner is manufactured commercially, a 1% increase in yield translates to an about 17 kg increase in dry toner per batch with a yield of 1700 kg of dry toner from a 3000 gallon reactor. Practicing the instant methods, about a 2% increase in yield is obtained.

Processing time also is reduced, both when considering latex production but also the EA process per se as the heat treatment shortens the resin production time and conditions the surface of the latex particles to enhance aggregation. The increase in yield inversely correlates 1:1 to a decrease in processing time. The processing time of a commercially run can be at least about 1.5% shorter, at least about 1.75% shorter, at least about 2% shorter, at least about 2.25% shorter, at least about 2.5% shorter, or more than observed when resin used in the toner is produced by PIE but is not heat-treated, during the solvent stripping step. Hence, as 2% increase in yield is equivalent to a 2% decrease in overall processing time, which in a commercial production run can be about 10 hours less over a 20 batch, four day campaign, The subject matter now will be exemplified in the following non-limiting examples. Parts and percentages are by weight unless otherwise indicated.

EXAMPLES

Example 1

Production of Latex

An LMW amorphous polyester resin and an HMW amorphous polyester resin are used to produce latex using phase inversion emulsification (NE). The polyester resins are dissolved in a mixture MEK and IPA, DIW (I) and ammonia (I). The ammonia (I) is used to neutralize the polyester to promote resin dispersion within the mixture of organic solvents and DIW (I). Ammonia (II) then is added to the homogenous resin dissolution followed by the addition of DIW (II) to generate a uniform suspension of polyester particles in the water continuous phase via phase inversion. The formulations of the two emulsions are provided in Tables 1 and 2.

TABLE 1

HMW Latex

| Chemicals | Parts | Percentage % |
|---|---|---|
| HMW resin | 10 | 26.2 |
| MEK | 6 | 15.7 |
| Isopropyl Alcohol | 1.8 | 4.7 |
| Ammonia (I) | 0.11 | 0.3 |
| DIW (I) | 6.25 | 16.4 |
| Ammonia (II) | 0.22 | 0.6 |
| DIW (II) | 13.74 | 36.0 |
| Total | 38.12 | 100 |

TABLE 2

LMW Latex

| Chemicals | Parts | Percentage % |
|---|---|---|
| LMW Resin | 10 | 27.0 |
| MEK | 6 | 16.2 |
| Isopropyl Alcohol | 0.7 | 1.9 |
| Ammonia (I) | 0.11 | 0.3 |
| DIW (I) | 5.0 | 13.5 |
| Ammonia (II) | 0.22 | 0.6 |
| DIW (II) | 15.0 | 40.5 |
| Total | 37.0 | 100 |

Example 2

Thermal Treatment

The latexes of Example 1 were separated between two distillation apparatus with one having the beating jacket set at the conventional 58° C. and the other with the jacket set at 65° C. which is above the Tg of the HMW and LMW resins. Distillation was continued until the content of volatile organic compounds (VOC) was below about 300 ppm, as determined by gas chromatography (GC). The distilled latexes then were freeze dried and characterized. Table 3 lists the properties of latexes distilled at 58° C. and 65° C.

TABLE 3

| Latex | Jacket Temp (C °) | PS (nm) | Acid # (mg KOH/g) | Tg Onset (2nd heat) | MW (kpse) | Mp (kpse) | Mn (kpse) | Mz (kpse) | MWD (pse) |
|---|---|---|---|---|---|---|---|---|---|
| LMW | 58 | 180 ± 47 | 11.6 | 61.1 | 18.1 | 11.4 | 4.5 | 44.7 | 4.1 |
| LMW | 65 | 173 ± 49 | 11.5 | 61.1 | 17.6 | 11.2 | 4.5 | 43.1 | 3.9 |
| HMW | 58 | 194 ± 48 | 12.6 | 56.8 | 77.1 | 11.9 | 5.1 | 437.3 | 15.1 |
| HMW | 65 | 202 ± 51 | 12.2 | 57.1 | 78.9 | 12.0 | 5.2 | 447.0 | 15.2 |

pse is poly-styrene (PS) equivalents. The GPC is calibrated with PS standards of known molecule weight, expressed in g/mol. kpse is kilo pse.

During, the distillation process practicing the method of interest with the jacket temperature at 65° C., the latex particles would have instant and sufficient contact with the vessel surface where the temperature was higher than the $T_g$ of latex particles. Since the solvents were distilled continuously under vacuum, the solvents evaporated. Due to evaporative cooling which removed heat from the reactor, a stable hatch temperature of about 45° C. was obtained. Therefore the latex particles only saw a brief, transitory thermal treatment when contacting the inner surface of the vessel while being stirred.

The data indicate that the higher jacket temperature did not deleteriously affect any latex property, such as particle size, $T_g$ and molecular weight, widely considered to be critical for toner composition and properties. Therefore, the 65° C. jacket temperature. As revealed in the toner of Example 3 below, removed a significant portion of the steric barrier on the latex particle surface without: comprising any latex properties. That temperature also resulted in distilling the solvents more rapidly, resulting in 25% shorter distillation cycle time, thus lowering production expense.

Example 3

Toner Production Using Thermal-Treated Latexes

Magenta toner has been one of the most difficult to produce with poor yields and very broad geometric size distributions (GSD's) (both for coarse and fines) as compared to the other colors. The problem may be associated with the red colorants.

Magenta core-shell toner was made by a standard EA procedure. The resulting toner contained 39% LMW amorphous polyester resin, 39% MHW amorphous polyester resin, 7% crystalline polyester resin, 9% wax and 6% magenta colorant. The amorphous resins were made by a standard PIE process or using the heat treatment during distillation as taught herein.

With the thermal-treated latexes used in manufacturing magenta toner, the yield was over 96%. That was especially unexpected taking into account that for that month, a low number of batches were completed (7 batches as compared to an average of 12/month the previous 5 months). Overall yield generally is positively correlated to the length of the overall campaign and the number of batches produced in that campaign, with the longer campaigns usually leading to higher overall yields. The average yield of magenta toner generally was about 93% when using control latexes. The yields for magenta toner were also higher than that of black, cyan and yellow toners for the month.

After observing that improvement in yield, in the presence of the smaller campaign size, the data were analyzed further. The main reason for the yield improvement was found to be that the overall coarse content, as measured by the volumetric $D_{84/50}$, was about 0.004 units lower than the four month average and 0.002 units lower than the previous low within that period. That improvement in yield due to reduced coarse particle content was more than 0.005 units lower than that of the nominal average production throughout the year. With the lowering of the overall coarse content ($VD_{84/50}$), less toner was lost though the wet sieving process (where the excess coarse particles are collected and discarded).

Example 4

Improvement on Cycle Time

Even with increase in yield, it can be counterproductive to efficient and economical production if the process did not result in at least an equal or higher throughput than standard. Data revealed that the highest throughput (800 kg/hr) during the month was obtained in the magenta toner using the thermally-treated latexes, as compared with an average, tallied by month, of less than 600 kg/hr for magenta toner made with conventionally produced resins, or toners of other colors. It is unexpected to see that level of production during a summer month when higher humidity in the production facility decreases the ability to dry the polyester particle (due to the high affinity of polyester for water). Unexpectedly, even with those additional environmental challenges, the highest throughput was obtained using the thermally-treated latexes, and surprisingly, that occurred with the magenta toner lots.

It will be appreciated that variations of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material. Words, expressions, terms, symbols, etc. used herein unless defined explicitly or in context are understood to have meaning as generally used by those familiar with toner technology.

All references cited herein are herein incorporated by reference in entirety.

We claim:

1. A method of making a magenta toner comprising:

(a) making a latex by phase inversion emulsification (PIE) of a first emulsion comprising a first resin and a solvent, wherein solvent is distilled with said first emulsion exposed to a temperature above the Tg of an amorphous resin, the melting point of a crystalline resin or both when contained in said first emulsion;

(b) combining the latex with a wax and a magenta colorant to form a second emulsion;

(c) adding an aggregating agent to said second emulsion to form aggregated particles; and (d) coalescing said aggregated particles to form said magenta toner in commercial quantities, wherein said magenta toner is produced in a higher yield, at a higher throughput, in less time, or a combination thereof, as compared to a similarly made control magenta toner comprising a control resin made with a solvent distillation temperature below the Tg of an amorphous resin, the melting point of a crystalline resin or both when contained in said control resin.

2. The method of claim 1, wherein said solvent comprises a mixture of methyl ethyl ketone (MEK) and isopropyl alcohol (IPA).

3. The method of claim 1, wherein said first resin comprises an amorphous polyester resin.

4. The method of claim 1, wherein said first resin comprises at least two amorphous polyester resins.

5. The method of claim 1, wherein the first resin comprises a low molecular weight amorphous polyester resin and a high molecular weight amorphous polyester resin.

6. The method of claim 1, wherein said magenta toner comprises a VD84/VD50 or about 1.23 or less; an ND50/ND16 of about 1.30 or less; or both.

7. The method of claim 1, wherein said first resin comprises a crystalline polyester resin.

8. The method of claim 1, wherein said magenta toner is produced at a throughput of at least about 700 kg/hr.

9. The method of claim 1, wherein said magenta toner is produced with a commercial yield at least about 1.5% greater than yield of a magenta toner made with a latex not heat-treated.

10. The method of claim 1, wherein said magenta toner is produced commercially with a processing time at least about 1.5% shorter than processing time of a magenta toner made with a latex not heat-treated.

11. The method of claim 1, wherein said wax is in an amount from about 1 wt % to about 25 wt %.

12. The method of claim 1, wherein said magenta colorant is in an amount from about 3 wt % to about 15 wt %.

13. The method of claim 1, wherein said magenta colorant comprises pigment red (PR) 122, PR185, PR192, PR202, PR206, PR235, PR269 or combinations thereof.

14. The method of claim 1, further comprising adding a latex to said aggregated particles of step (c) to form a shell.

15. The method of claim 14, wherein said latex comprises a metal resin.

16. The method of claim 15, wherein said metal resin is a calcium resinate, a beryllium resinate, a magnesium resinate, a strontium resinate, a barium resinate, a radium resinate, a zinc resinate, an aluminum resinate, a copper resinate, an iron resinate or combinations thereof.

17. The method of claim 1, wherein said latex comprises a metal resin.

18. The method of claim 17, wherein said metal resin comprises a calcium resinate, a beryllium resinate, a magnesium resinate, a strontium resinate, a barium resinate, a radium resinate, a zinc resinate, an aluminum resinate, a copper resinate, an iron resinate or combinations thereof.

19. The method of claim 1, wherein said magenta toner comprises PR122, PR269 or combination thereof.

20. The method of claim 1, wherein said magenta toner comprises equal amounts of PR122 and PR269.

* * * * *